US005254965A

United States Patent [19]

Sandell

[11] Patent Number: 5,254,965

[45] Date of Patent: Oct. 19, 1993

[54] PROTECTIVE REED SWITCH HOUSING

[75] Inventor: Donald R. Sandell, Shingle Springs, Calif.

[73] Assignee: C & K Systems, Inc., Folsom, Calif.

[21] Appl. No.: 798,492

[22] Filed: Nov. 26, 1991

[51] Int. Cl.[5] ..... H01H 9/02

[52] U.S. Cl. ..... 335/202

[58] Field of Search ..... 73/431; 200/61.62; 340/547, 551; 361/142, 357; 335/17, 156, 202, 278, 193; 324/179

[56] References Cited

U.S. PATENT DOCUMENTS

| | | | |
|---|---|---|---|
| 2,904,656 | 9/1959 | Harry | 335/156 |
| 2,923,791 | 2/1960 | Corbitt et al. | 335/202 |
| 3,250,875 | 5/1966 | Wintriss | 335/202 |
| 4,005,295 | 1/1977 | Mitchell et al. | 200/61.62 |
| 4,246,457 | 1/1981 | Teichert et al. | 335/202 |
| 4,371,856 | 2/1983 | Holce et al. | 335/202 |
| 5,004,879 | 4/1991 | Bernhardt et al. | 335/202 |

*Primary Examiner*—Robert Raevis
*Attorney, Agent, or Firm*—Limbach & Limbach

[57] ABSTRACT

A protective housing for enclosing a reed switch which includes an elongate hollow member having an opening at one end for access to a cavity inside the member. The cavity is sized to permit insertion of the reed switch inside the cavity. Fillant substantially closes the opening of the hollow member without making contact with the body of the reed switch. The fillant surrounds wires which are attached to the connecting leads of the reed switch. A method, which utilizes a blocking member, of enclosing a reed switch in a hollow member is also disclosed.

6 Claims, 3 Drawing Sheets

PROTECTIVE REED SWITCH HOUSING

BACKGROUND OF THE INVENTION

1. Field of the Invention

The present invention relates to magnetic contacts for use in intrusion detection systems, and more particularly, to a protective housing for enclosing a reed switch.

2. Description of the Related Art

Intrusion detection systems, such as those used in burglar alarms, typically include two basic components: an intrusion detector and an intrusion indicator. An intrusion detector is used to monitor a given situation and provide information needed in determining whether an abnormal condition exists, such as the presence of an intruder. An intrusion indicator analyzes information received from an intrusion detector and determines whether an intrusion has occurred. If an intrusion has occurred, then the intrusion indicator generates some type of warning signal, such as flashing lights, ringing bells, or in more modern systems, a digital signal transmitted via telephone lines to a security system computer.

One type of intrusion detector is a metallic tape that is placed across all door and door frames and window and window frames of a building. The tape has an electric current passing through it which causes the intrusion indicator to determine that no intrusion has occurred. Any intruder entering the building will break the tape which will interrupt the current. The intrusion indicator will interpret the current interruption as indicating that an intrusion has occurred.

Another type of intrusion detector is a magnetic contact. A magnetic contact often includes a dry-reed switch (or simply "reed switch"), and an external magnet. FIG. 1 illustrates a reed switch 10. The switch 10 consists of two thin, metallic strips (or "reeds") 12 and 14 that are hermetically sealed in a delicate glass tube-like body 16. The glass body 16 is filled with an inert gas. Each of the reeds 12 and 14 is connected to a respective connecting lead 18 and 20.

When an external magnet is brought near the switch 10, the magnet attracts one of the reeds 12 or 14, which then contacts the other reed 12 or 14. When the reeds 12 and 14 come into contact, the circuit which is connected to the connecting leads 18 and 20 closes.

When used as an intrusion detector, the reed switch 10 and external magnet operate in a manner similar to the metallic tape detector. The switch 10 is usually installed in a hole in the wooden frame above a door. The external magnet is mounted on the door at a location which is near the switch 10 when the door is closed. When the door is closed, the reeds make contact due to the presence of the magnet, and current passes through the switch 10. When the door is opened, such as by an intruder, the external magnet is moved away from the switch 10 which causes the reeds to separate, and thus, the current is interrupted.

Before insertion into a hole of a wooden door frame, the reed switch 10 is typically enclosed within a cylindrical plastic housing in order to protect its delicate glass body 16. Often, two reed switches are contained in one plastic housing. The cylindrical plastic housing has one open end and is generally long enough to enclose the entire length of the switch, as well as a short portion of the wires which are coupled to the connecting leads.

The reed switch must be secured within the plastic housing because it can easily fall out. Securing the switch within the housing, however, presents more of a problem than appears at first blush. Because the reed switch is a magnetic device, it cannot be secured in the housing with any type of metallic fastener because the metal would interfere with the operation of the switch. Furthermore, the reed switch is a delicate and very tiny device, often having a glass body length of only 0.53 inches. Thus, it cannot be secured in the housing by means of plastic screws, bolts, rivets, or like plastic fasteners because these fasteners are too large and would destroy the switch.

Therefore, after the reed switch has been inserted into the plastic housing, it has traditionally been secured by filling the entire housing with a fillant, typically epoxy adhesive. Since the epoxy is not metallic, it does not interfere with the operation of the switch. Since the epoxy is initially in liquid form, it does not harm the delicate switch. The entire housing can be quickly and easily filled with the liquid epoxy; this is a particularly advantageous quality because it has always been thought that filling the entire housing provided the best and most secure method of holding the switch in the housing. After it is hardened, the epoxy surrounds the entire switch such that there is no room for movement.

While the above method initially works well in securing a reed switch, it has been found that after a switch and housing have been implanted in a wooden door frame for a period of time, the switch often malfunctions. The malfunction is normally due to the glass body of the switch becoming cracked or broken. A reed switch will not function with a cracked or broken glass body.

Thus, there has emerged a compelling need for a reed switch housing which will protect the glass body of a reed switch from becoming cracked or broken over long periods of time.

SUMMARY OF THE INVENTION

The present invention provides a protective housing for enclosing a reed switch. The housing includes an elongated hollow member having an opening at one end for access to a cavity inside the member. The cavity is sized to permit insertion of the reed switch inside the cavity. Fillant is positioned inside the cavity at the opening for substantially closing the opening of the hollow member. The fillant does not make contact with the body of the reed switch. The fillant surrounds the wires attached to the connecting leads of the reed switch.

The present invention also provides a method of enclosing a reed switch in a hollow member such that the fillant does not make contact with the body of the reed switch. This method makes use of a blocking member to keep the epoxy from contacting the switch.

A better understanding of the features and advantages of the present invention will be obtained by reference to the following detailed description of the invention and accompanying drawings which set forth an illustrative embodiment in which the principals of the invention are utilized.

DETAILED DESCRIPTION OF THE PREFERRED EMBODIMENT

It is believed that the wood in a door frame in which a reed switch plastic housing is installed goes through many cycles of expansion and contraction over the course of a year. These expansions and contractions tend to place stress on the plastic housing. If the entire plastic housing is filled with hardened epoxy which totally encases the switch, the stress on the housing is transferred to the switch's delicate glass body which can cause it to crack or break.

One may initially think that this problem can be solved by only partially filling the plastic housing; in other words, provide only enough liquid epoxy to fill about one-half of the housing from the closed end to the open end. This solution, however, will not solve the problem. Because the connecting leads of the switch are fairly short, the glass body of the switch will be close to the closed end of the housing. Therefore, even a small amount of epoxy will come into contact with the glass body. Having any part of the glass body in contact with the epoxy may result in breaking the glass.

Figure 1:
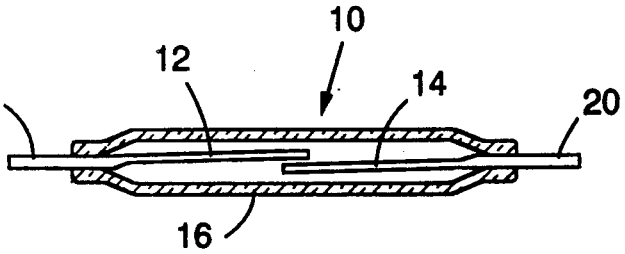
(PRIOR ART) FIG. 1
FIG. 1 is an illustration of a prior art reed switch.
Figure 2:
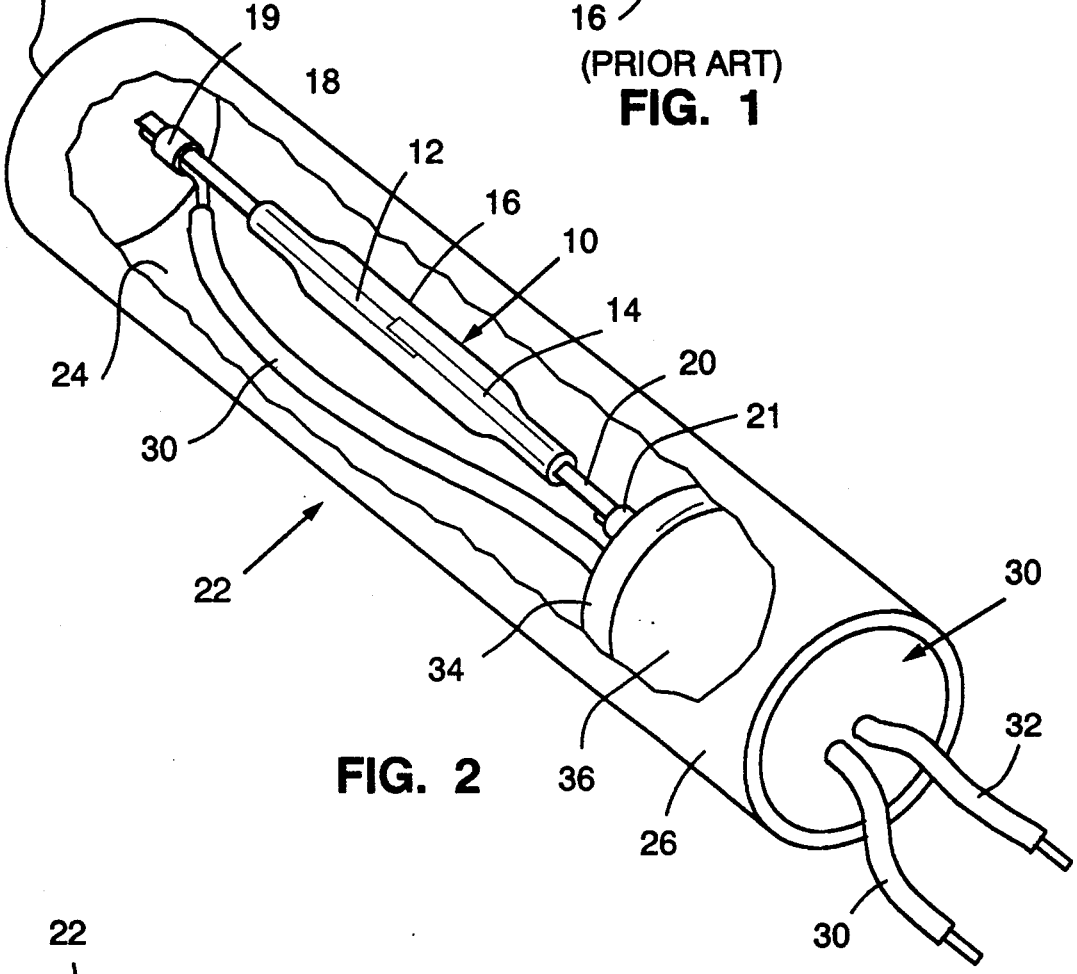
FIG. 2 is a cut-away perspective view of a protective reed switch housing in accordance with the present invention.
Figure 3:
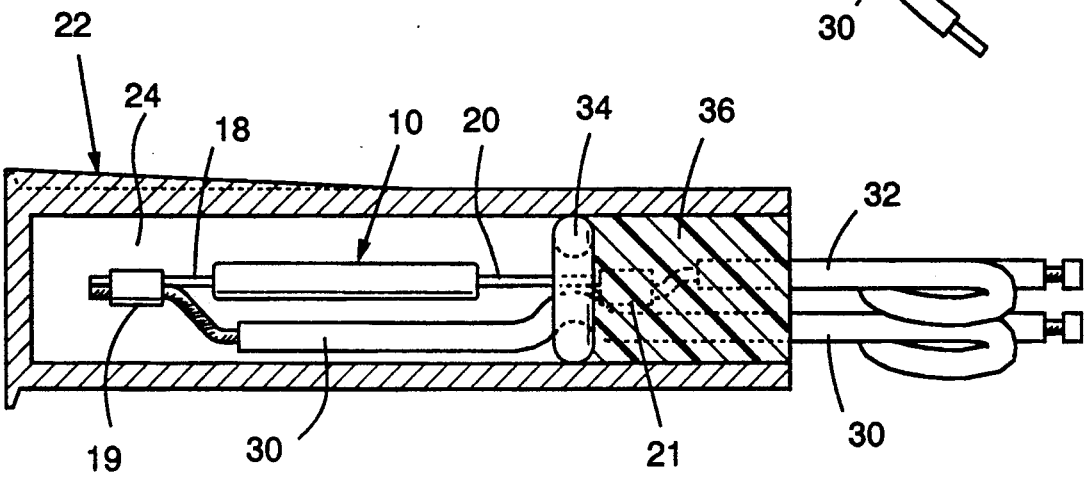
FIG. 3 is a cross-sectional view of the protective reed switch housing of FIG. 2.
Figure 4A:
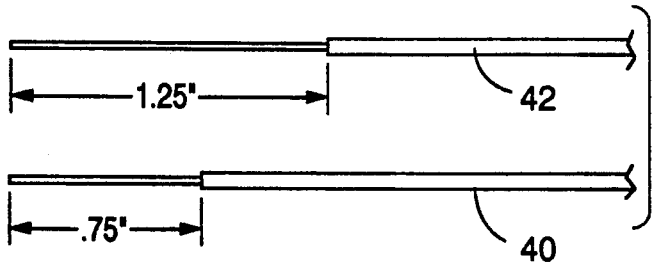
FIGS. 4(*a*)-(*f*) are perspective views illustrating a method of coupling wires to the connecting leads of a reed switch, as well as insertion of the reed switch into a housing in accordance with the present invention.
Figure 4B:
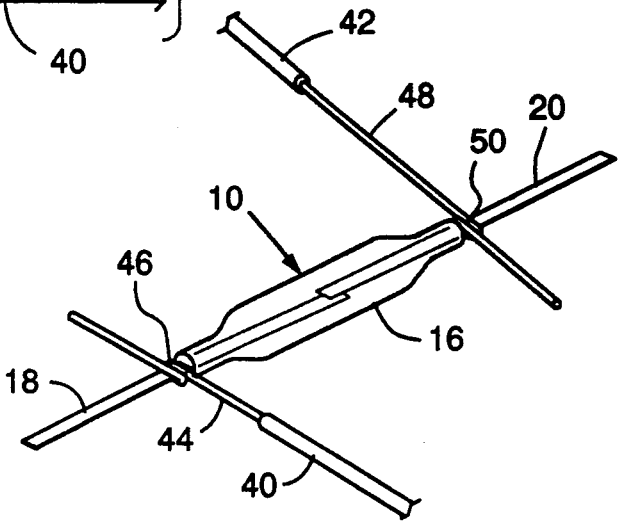
Figure 4C:
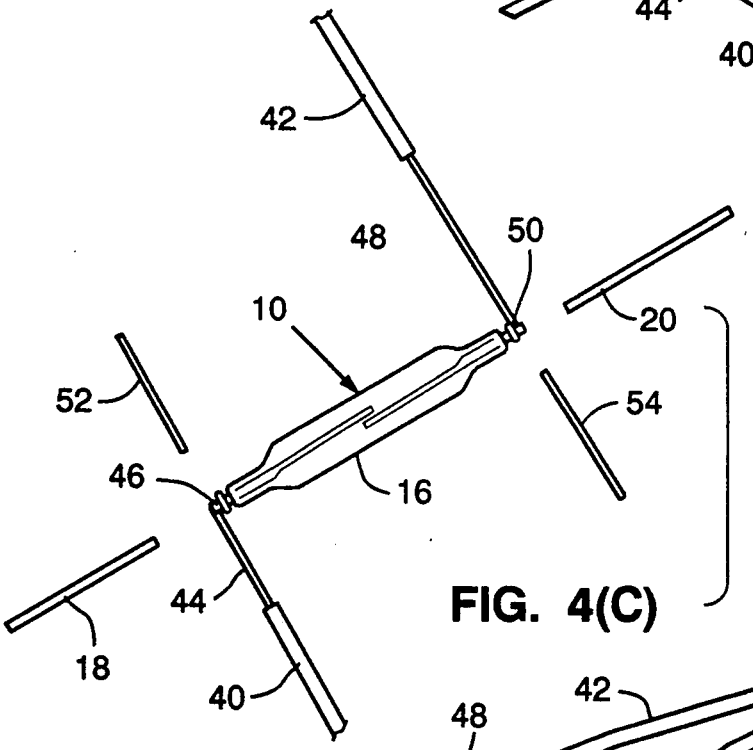
Figure 4D:
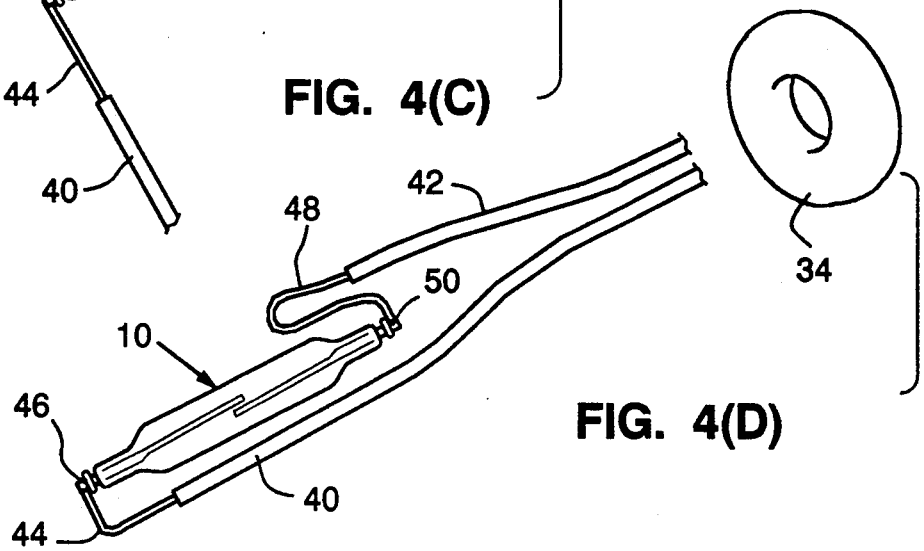
Figure 4E:
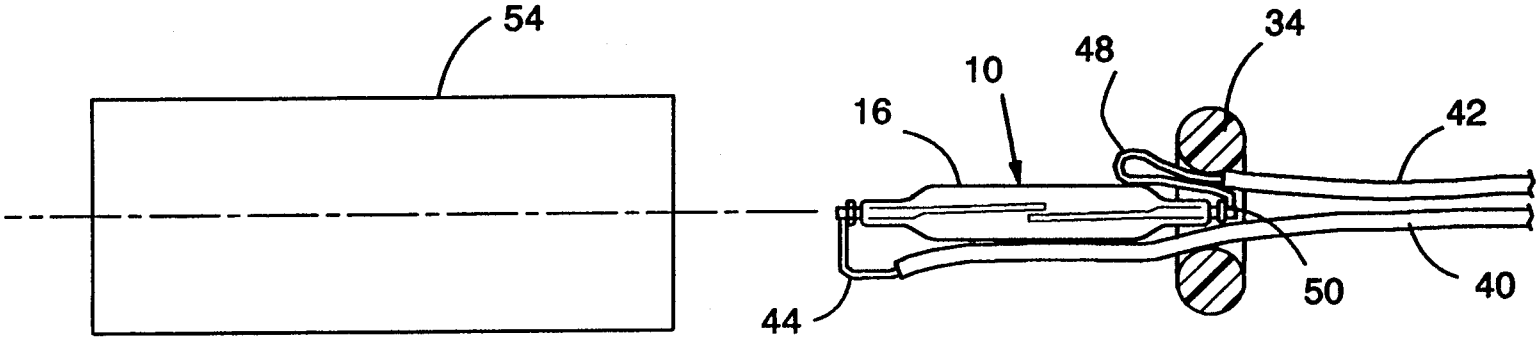
Figure 4F:
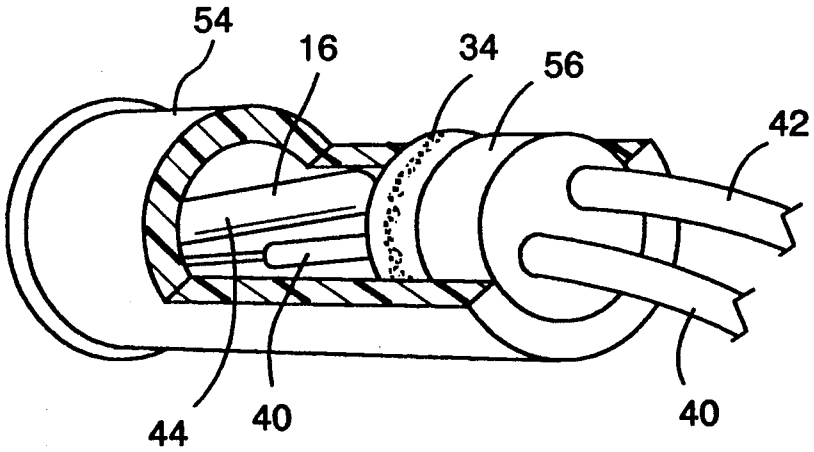

FIGS. 2 and 3 illustrate one embodiment of a protective reed switch housing 22 in accordance with the present invention. A prior art reed switch 10 is enclosed within a cavity 24 of a cylindrical, hollow, plastic housing member 26. In this embodiment, the housing member 26 has an inside diameter of 0.2598 inches, a length of 1.25 inches, and is constructed from ABS plastic. Furthermore, the reed switch 10 is preferably part no. R1-07AAA dry-reed switch manufactured by Philips Components of the Netherlands. Its glass body 16 has a length of 0.53 inches and a width of 0.071 inches.

The cavity 24 should be large enough such that if the switch 10 is suspended in the center of the cavity 24, the cavity walls will not make contact with the glass body 16. The housing 26 should be long enough to enclose the entire length of the switch 10, as well as a short portion of the wires 30 and 32 which are coupled to the connecting leads 18 and 20. The housing 26 has a closed end 28 and an open end 30.

While other methods may be used to couple wires 30 and 32 to connecting leads 18 and 20, in the embodiment shown in FIGS. 2 and 3, these wires are coupled to the connecting leads by means of crimping and soldering. A brass crimp connector 19 is used to couple wire 30 to connecting lead 18. Solder is then applied to the ends of crimp connector 19 to insure strength and a good electrical connection. Similarly, a brass crimp connector 21 is used to couple wire 32 to connecting lead 20. Solder is applied to the ends of crimp connector 21 as well.

A blocking member 34 is placed around the wires 30 and 32. As the switch 10 is inserted into the open end 30 of the housing 26, the blocking member 34 is positioned inside the cavity 24 a short distance from the open end 30. The blocking member 34 has a hole, preferably at its center, to allow the wires 30 and 32 to pass through.

An O-ring, grommet, or the like, may be used as the blocking member 34. In the preferred embodiment, a 0.25 inch outside diameter and 0.125 inch inside diameter #006 nitrile (BUNA-70) O-ring manufactured by Parker Co. of Irvine, Calif. is used for the blocking member 34.

The blocking member 34 seals off the open end 30 of the housing 26 from the switch 10. Furthermore, the blocking member 34 defines a space between itself and the open end 30. This space is filled with a fillant 36. The fillant 36 may be epoxy adhesive, or the like. In the preferred embodiment, DP-420 Scotch-Weld® off-white epoxy adhesive (3M I.D. no.: 62-3280-1435-2) manufactured by 3M Co. of St. Paul, Minn. is used as the fillant 36. This epoxy is applied to the housing 26 with a 3M Scotch-Weld® EPX applicator and mixing gun.

The blocking member 34 prevents the fillant 36 from coming into contact with the glass body 16 of the switch 10. Because, the switch 10 is surrounded by an air filled cavity 24 rather than epoxy, mechanical stresses on the housing 26 do not effect the glass body 16.

In the preferred embodiment, the blocking member 34 is positioned very close to the glass body 16, provided that no fillant 36 is permitted to make contact with the glass body 16. If the hardened fillant 36, which surrounds the wires 30 and 32, is very close to the glass body 16, the fillant 36 will tend to suspend the switch 10 in the center of the cavity 24 such that no part of the switch 10 makes contact with the cavity walls. While suspending the switch 10 in the center of the cavity 24 is preferred, it is not necessary. The switch 10 will function properly if it is permitted to rest on the cavity walls. The main concern is that no fillant 36 makes contact with the glass body 16.

FIGS. 4(*a*)-(*f*) illustrate an alternative embodiment of the protective reed switch housing in accordance with the present invention. This embodiment uses a shorter housing and an alternative method of coupling the wires to the connecting leads of the reed switch.

Referring to FIG. 4(*a*), about 1.25 inches of insulation is removed from a wire 42, and about 0.75 inches of insulation is removed from another wire 40. More insulation is removed from wire 42 because, as will be discussed below, a "180° double-back" will be formed out of the exposed conductor. The wire used for wires 40 and 42 is preferably twenty-two gauge regular braided wire.

The exposed conductor of wire 40 is wrapped 360° around connecting lead 18 of the switch 10 forming a wrapped wire joint 46, as illustrated by FIG. 4(*b*). Plenty of exposed conductor 44 should be left between the wrapped wire joint 46 and the insulation of wire 40. The wrapped wire joint 46 should be pushed up against the glass body 16 Similarly, the exposed conductor of wire 42 is wrapped 360° around connecting lead 20 forming a wrapped wire joint 50. Plenty of exposed conductor 48 should be left between the wrapped wire joint 50 and the insulation of wire 42. The wrapped wire joint 50 is pushed up against the glass body 16.

Solder is applied to the wrapped wire joints 46 and 50 in order to solder the joints to the connecting leads 18 and 20, respectively. Care should be used to insure that no solder is applied to the exposed conductors 44 and 48 because these conductors are to be bent.

Referring to FIG. 4(*c*), the excess portions of connecting leads 18 and 20 are cut off at a point close to the wrapped wire joints 46 and 50. The excess exposed conductors 52 and 54 of wires 40 and 42 are also cut off at a point close to the wrapped wire joints 46 and 50. The length of each wrapped wire joint 46 and 50 should preferably be about 0.08 inches; this length is measured from the end of the glass body 16 to the end of each respective wrapped wire joint. Because the length of the glass body 16 of the switch 10 is about 0.53 inches, the overall length of the glass body 16 and the wrapped wire joints 46 and 50 should preferably be a maximum of 0.70 inches.

FIG. 4(*d*) illustrates that the exposed conductor 44 of wire 40 is carefully bent 90° so that the insulated portion of wire 40 extends parallel to the switch 10. The exposed conductor 48 of wire 42 is first carefully bent 90° towards the other end of the switch 10, and then is carefully bent back 180° in the opposite direction. This is referred to as a "180° double-back" and its purpose is to position the start of the insulation of wire 42 next to the wrapped wire joint 50. Because this embodiment uses a shorter housing than the embodiment discussed above, the 180° double back will insure that all of the exposed conductor 48 is kept inside the housing.

Furthermore, the 180° double back relieves the stress that the exposed conductor 48 places on the wrapped wire joint 50.

FIG. 4(*e*) illustrates the switch 10 with the blocking member 34 in place. The blocking member 34 is preferably positioned over a portion of the 180° double back 48 with the wrapped wire joint 50 at about the center of the hole through the blocking member 34. Once the blocking member 34 is in place, the switch 10 is ready to be inserted into a cylindrical hollow plastic housing 54.

The housing 54 is shorter than the housing 26 used in the embodiment discussed above. The housing 54 preferably has length of 0.75 inches, an inside diameter of 0.2598 inches, and is constructed from ABS plastic. Because the housing 54 has the same inside diameter as the housing 26, the same preferred O-ring mentioned above can be used for the blocking member 34.

After the switch 10 and blocking member 34 combination are inserted into the housing 54, the space between the blocking member 34 and the open end of the housing 54 is filled with a fillant. FIG. 4(*f*) is a cross-sectional perspective view illustrating a fillant 56 positioned in the space between the blocking member 34 and the open end of the housing 54. The preferred fillant and device used to apply it are the same as was discussed above. The switch 10 is preferably suspended in the center of the housing 54 without contacting the housing walls, but this suspension is not necessary. It is believed that the switch 10 will function just as well if it rests on the inside walls of the housing 54.

One advantage of the embodiment shown in FIGS. 4(*a*)-(*f*) over the embodiment shown in FIGS. 2 and 3 is that the final length of the connecting leads 18 and 20 of the switch 10 are shorter in the embodiment of FIGS. 4(*a*)-(*f*). This is advantageous for two reasons. First, the shorter the connecting leads 18 and 20, the shorter the housing. Second, stress on the connecting leads 18 and 20 relative to the delicate glass body 16 can cause the glass to crack or break. Shorter connecting leads 18 and 20 are less likely to be subject to stress.

The method of encapsulating a reed switch disclosed herein provides for a very long life of the switch while adequately securing the switch within the plastic housing.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. A reed switch assembly, comprising:

an elongate member having a substantially enclosed cavity therein defined by cavity walls and having a hole therethrough at one end thereof;

a reed switch having a body and first and second connecting leads, said reed switch being positioned completely inside said cavity;

first and second wires attached to said first and second connecting leads, respectively, said first and second wires extending through said hole in said elongate member to suspend said reed switch in said cavity such that said body of said reed switch does not make contact with said cavity walls of said elongate member and such that one of said first and second connecting leads remains suspended in free space within said cavity.

2. A reed switch assembly, comprising:

an elongate hollow member having an opening at one end thereof for access to a cavity therein;

a reed switch having a body and first and second connecting leads, said reed switch being positioned completely inside said cavity;

first and second wires attached to said first and second connecting leads, respectively, said first and second wires extending through said opening of said elongate hollow member;

fillant positioned in said cavity at said opening for substantially closing said opening of said hollow member, said fillant extending into said cavity to a point short of said body of said reed switch and surrounding said first and second wires to suspend said reed switch in said cavity such that said body of said reed switch and said first and second connecting leads do not make contact with said elongate hollow member and such that one of said first and second connecting leads remains suspended in free space within said cavity.

3. The reed switch assembly of claim 2, further comprising:

a blocking member positioned inside said cavity between said body of said reed switch and said fillant, said blocking member surrounding said first and second wires to further support said reed switch, to substantially center said reed switch in said cavity, and to prevent said fillant from contacting said body of said reed switch.

4. The reed switch assembly of claim 3, wherein said blocking member comprises an O-ring.

5. The reed switch assembly of claim 2, wherein said elongate hollow member comprises a hollow plastic cylinder.

6. The reed switch assembly of claim 2, wherein said fillant comprises epoxy adhesive.

* * * * *